United States Patent [19]

Hughes

[11] 4,196,370

[45] Apr. 1, 1980

[54] CRT GENERATING THREE INLINE BEAMS AND HAVING SHUNTS FOR WEAKENING CENTER BEAM HORIZONTAL MAGNETIC DEFLECTION AND STRENGTHENING VERTICAL DEFLECTION

[75] Inventor: Richard H. Hughes, Lancaster, Pa.

[73] Assignee: RCA Corporation, New York, N.Y.

[21] Appl. No.: 881,022

[22] Filed: Feb. 24, 1978

[51] Int. Cl.[2] ..... H01J 29/76; H01J 29/51

[52] U.S. Cl. ..... 313/413; 313/412

[58] Field of Search ..... 313/413, 412, 414, 409, 313/411

[56] References Cited

U.S. PATENT DOCUMENTS

| | | | |
|---|---|---|---|
| 3,873,879 | 3/1975 | Hughes | 315/13 C |
| 3,892,996 | 7/1975 | Morrell et al. | 313/413 |
| 4,057,747 | 11/1977 | Hamano | 313/414 X |
| 4,142,131 | 2/1979 | Ando et al. | 313/412 X |

*Primary Examiner*—Robert Segal

*Attorney, Agent, or Firm*—E. M. Whitacre; G. H. Bruestle; D. H. Irlbeck

[57] ABSTRACT

An inline electron gun includes means for weakening the effect of a portion of the horizontal magnetic deflection field on the center electron beam and for strengthening the effect of a portion of the vertical magnetic deflection field on the center electron beam. The means includes magnetic shield members completely surrounding the paths of the outer beams. Each of the members has a portion that crosses the plane of the co-planar electron beam paths that is closer to the center beam path than to the outer beam paths. In a preferred embodiment, large shunts surrounding the outer beams are offset eccentrically toward the center beam relative to the outer beams.

2 Claims, 12 Drawing Figures

PRIOR ART
Fig. 3.
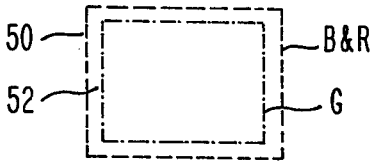
Fig. 6.
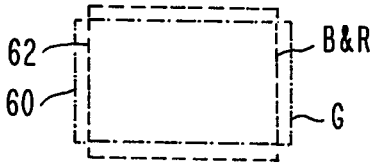
PRIOR ART
Fig. 4.
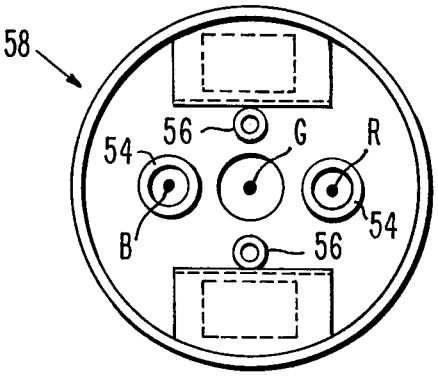
Fig. 7.
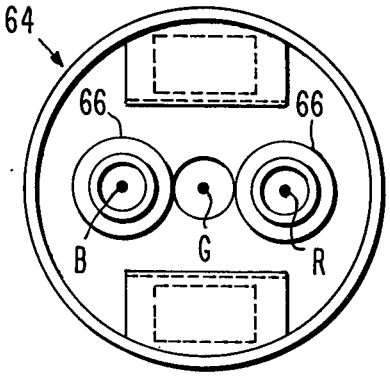
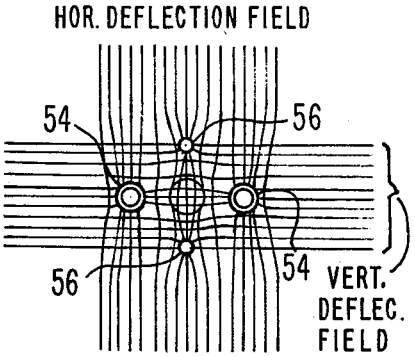
Fig. 5.
PRIOR ART
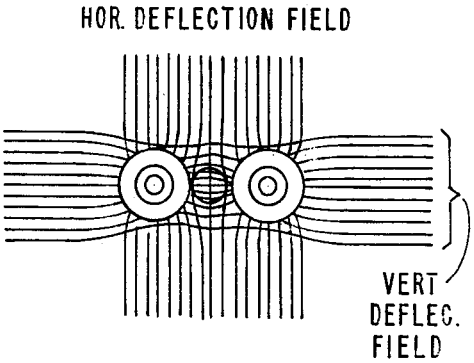
Fig. 8.

Fig. 9.
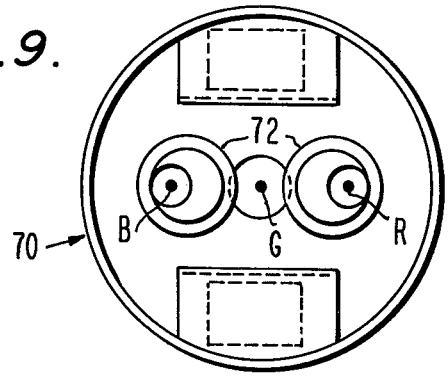
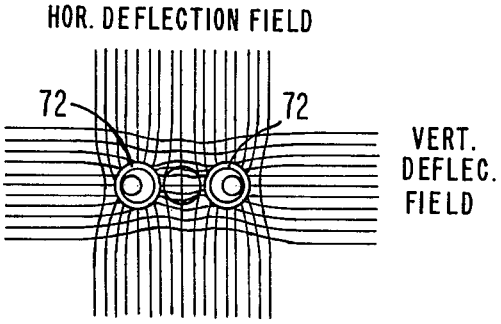
Fig. 10.
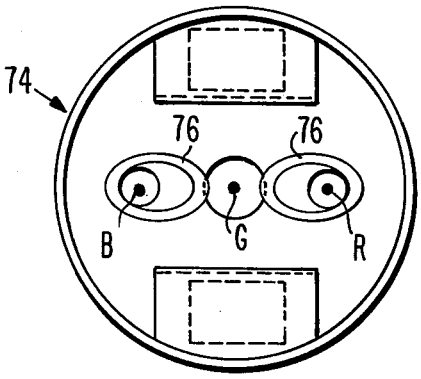
Fig. 11.
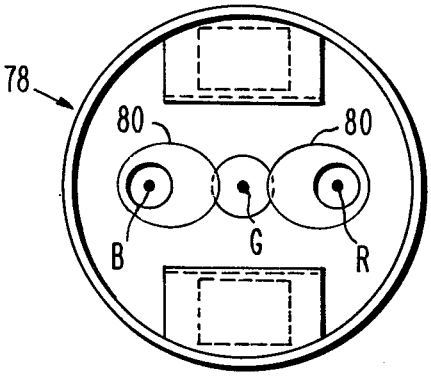
Fig. 12.

CRT GENERATING THREE INLINE BEAMS AND HAVING SHUNTS FOR WEAKENING CENTER BEAM HORIZONTAL MAGNETIC DEFLECTION AND STRENGTHENING VERTICAL DEFLECTION

BACKGROUND OF THE INVENTION

The present invention relates to a color picture tube having an improved inline gun, and particularly to an improvement in the gun for obtaining equal raster sizes (also called coma correction) within the tube.

An inline electron gun is one designed to generate or initiate preferably three electron beams in a common plane and direct those beams along convergent paths in that plane to a point or small area of convergence near the tube screen.

A problem that exists in a color picture tube having an inline gun is a coma distortion wherein the sizes of the rasters scanned on the screen by an external magnetic deflection yoke are different because of the eccentricity of the two outer beams with respect to the center of the yoke. Messineo et al. U.S. Pat. No. 3,164,737 issued Jan. 5, 1965, teaches that a similar coma distortion caused by using different beam velocities can be corrected by use of a magnetic shield around the path of one or more beams in a three gun assembly. Barkow U.S. Pat. No. 3,196,305, issued July 20, 1965, teaches the use of magnetic enhancers adjacent to the path of one or more beams in a delta gun, for the same purpose. Krackhardt et al. U.S. Pat. No. 3,534,208, issued Oct. 13, 1970, teaches the use of a magnetic shield around the middle one of three inline beams for coma correction. Yoshida et al. U.S. Pat. No. 3,548,249, issued Dec. 15, 1970, teaches the use of C-shaped elements positioned between the center and outer beams to enhance the effect of the vertical deflection field on the center beam. Murata et al. U.S. Pat. No. 3,594,600, issued July 20, 1971, teaches the use of C-shaped shields around the outer beams with the open sides of the members facing each other. These shields appear to shunt the vertical deflection field around all three beams. Takenaka et al. U.S. Pat. No. 3,860,850, issued Jan. 14, 1975, teaches the use of V-shaped enhancement members located above and below three inline beams and the use of C-shaped shields around the two outer beams. Hughes U.S. Pat. No. 3,873,879, issued Mar. 25, 1975, teaches the use of small disc-shaped enhancement elements above and below the center beam and ring shaped shunts around the two outer beams.

The inventions of all of the foregoing patents solve different raster correction problems. For example, in the Takenaka et al. patent the two V-shaped members and the two C-shaped members apparently correct for a raster pattern variation wherein the center beam has greater vertical deflection but lesser horizontal deflection than do the outer beams. The required correction therefore must decrease both the vertical and horizontal deflection of the outer beams, decrease the vertical deflection of the center beam and increase the horizontal deflection of the center beam. The four coma correction members of the gun disclosed in the Hughes patent correct for a raster pattern wherein the center beam has less deflection in both the vertical and horizontal directions than do the outer beams. This correction is made by decreasing both the vertical and horizontal deflection of the outer beams and increasing both the vertical and horizontal deflection of the center beam.

Another raster pattern problem has occured in recently developed inline tubes utilizing a yoke having toroidal vertical deflection windings and saddle horizontal deflection windings which cannot be solved by any of the fore-mentioned inline tube type coma correction arrangements. In this pattern, the central beam has lesser vertical deflection but greater horizontal deflection than do the outer beams. The following described invention provides coma correction for such raster patterns by the use of only two correction members of novel design rather than the four members taught by the prior art Takenaka et al. and Hughes patents.

SUMMARY OF THE INVENTION

The present invention is an improvement in a color picture tube having an inline electron gun for generating and directing three electron beams, comprising a center beam and two outer beams, along coplanar paths toward a screen of said tube. The three beams pass through a deflection zone adapted to have vertical and horizontal magnetic deflection fields established therein. The improvement comprises the inclusion of means for weakening the effect of a portion of the horizontal magnetic deflection field on the center electron beam and for strengthening the effect of a portion of the vertical magnetic deflection field on the center electron beam. Such means include magnetic shield members completely surrounding the paths of the outer beams. Each of these members has a portion thereof crossing the plane of the coplanar electron beam paths that is closer to the center beam path than to the outer beam paths.

BRIEF DESCRIPTION OF THE DRAWINGS

FIG. 3 illustrates electron beam raster patterns which are corrected by a prior art use of shunts and enhancers in an inline electron gun.

FIG. 4 is a plan view of the output end of a prior art electron gun wherein the gun includes shunts and enhancers for correcting the raster pattern shown in FIG. 3.

FIG. 5 illustrates the distortion of a portion of the vertical and horizontal fields caused by the shunts and enhancers of the prior art gun of FIG. 4.

FIG. 6 illustrates electron beam raster patterns which are corrected by the novel structures disclosed herein.

FIG. 7 is a plan view of the electron gun of FIG. 2 taken at line 7—7 illustrating one embodiment of members for correcting the raster patterns of FIG. 6.

FIG. 8 illustrates the distortion of a portion of the vertical fields caused by the raster correction members of the gun of FIGS. 2 and 7.

FIG. 9 is a plan view of the output end of an electron gun illustrating a second embodiment of members for correcting the raster patterns shown in FIG. 6.

FIG. 10 illustrates the distortion of a portion of the vertical and horizontal deflection fields caused by the raster correction members of the gun of FIG. 9.

FIGS. 11 and 12 are plan views of output ends of electron guns illustrating third and fourth embodiments of members for correcting the raster patterns of FIG. 6.

DETAILED DESCRIPTION OF THE PREFERRED EMBODIMENT

Figure 1:
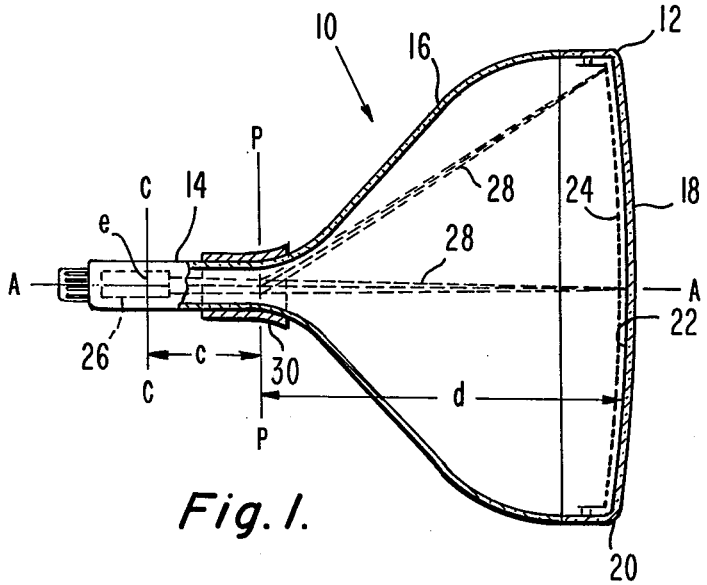
FIG. 1 is a plan view, partly in axial section of a shadow mask color picture tube in which one embodiment of the present invention is incorporated.

FIG. 1 is a plan view of a rectangular color picture tube having a glass envelope 10 comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A mosaic three-color phosphor screen 22 is carried by the inner surface of the faceplate 18. The screen is preferably a line screen with the phosphor lines extending substantially parallel to the minor axis Y—Y of the tube (in a plane normal to the plane of FIG. 1). A multi-apertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 schematically shown surrounding the neck 14 and funnel 12 in the neighborhood of their junction, for subjecting the three beams 28 to vertical and horizontal magnetic flux, to scan the beams horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the gun 26. For simplicity, the actual curvature of the deflected beam paths in the deflection zone is not shown in FIG. 1.

Figure 2:
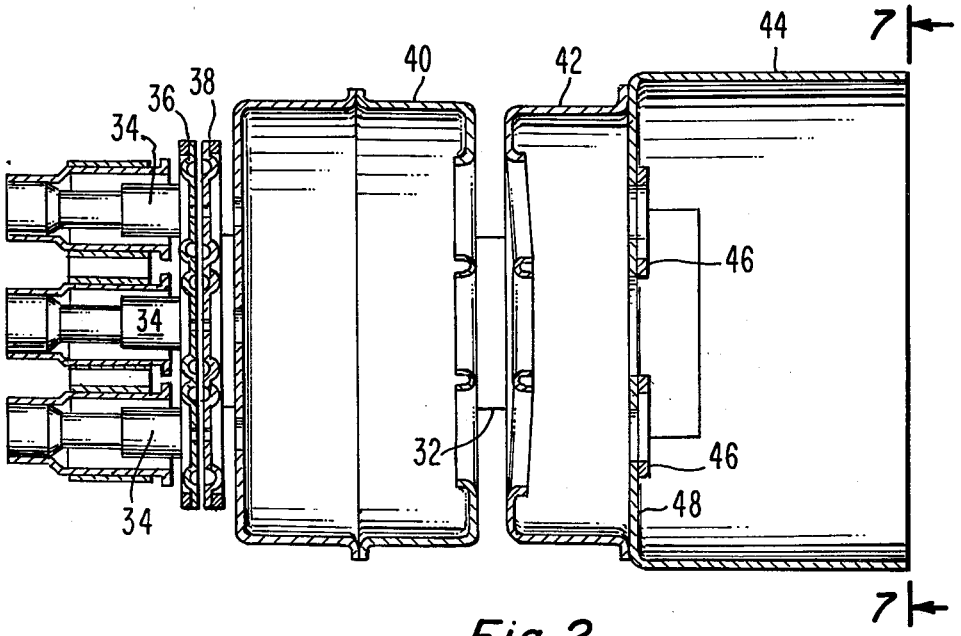
FIG. 2 is an axial section view of the electron gun shown in dashed lines in FIG. 1.

The details of the gun 26 are shown in FIG. 2. The gun comprises two glass support rods 32 on which the various electrodes are mounted. These electrodes include three equally spaced coplanar cathodes 34 (one for each beam), a control grid electrode 36, a screen grid electrode 38, a first accelerating and focusing electrode 40, and a second accelerating and focusing electrode 42, and an electrical cup 44, spaced along the glass rods 32 in the order named. Two raster correction members 46 are located on the back wall 48 of the shield cup 44 to surround the paths of the two outer beams. The shape, size, position and function of these members 46 will be discussed in greater detail later in the present description.

Greater detail of an electron gun such as gun 26 of FIG. 2 is contained in U.S. Pat. No. 3,772,554, issued to R. H. Hughes on Nov. 13, 1973. This patent is hereby incorporated by reference for the purpose of including such detail.

Three terms will be used herein to describe the function of various coma correction members used in electron guns. The term shunting refers to the complete bypassing of a particular portion of a magnetic deflection field from the path of an electron beam. The term enhancing is used to connote the concentrating of a portion of a magnetic deflection field at the path of an electron beam. The term negative enhancement refers to weakening a portion of a magnetic field at the path of an electron beam.

A pattern of rasters corrected by a prior art device is shown in FIG. 3. The outer dashed line 50 (also designated B and R) indicates the raster patterns for the two outer beams which in this case are the blue and red beams. The inner pattern of alternate dashes and dots 52 (also designated G) is the raster pattern for the center or green beam. As taught in Hughes U.S. Pat. No. 3,873,879, cited above, the raster patterns of FIG. 3 are corrected by the arrangement of shunts 54 and enhancers 56 shown in FIG. 4. In this prior art gun embodiment 58, the shunts 54 are small washer-shaped elements that closely surround the two outer beams, B and R. The two enhancers 56 are small washers or discs located directly above and below the center beam, G. The shunts 54 and enhancers 56 distort portions of the two deflection fields as shown in FIG. 5 to provide enhanced vertical and horizontal deflection of the center beam and decreased vertical and horizontal deflection of the two outer beams. Although the present invention provides gun embodiments with shunts that resemble the shunts of the former Hughes patent in that they completely surround the outer beams, the size, shape and position of the present shunts are different and perform different functions than do the shunts of the prior art Hughes patent.

FIG. 6 illustrates the recently encountered raster patterns described above. The center beam raster shown by an alternate dash and dot line 60 (also labeled G) has less vertical deflection but greater horizontal deflection than do the two outer beam rasters shown by the dashed line 62 also labeled B & R. Although these patterns can be corrected by the use of various combinations of shunts and enhancers as taught by the prior art, the present invention includes the use of only two novely designed correction members completely surrounding each outer beam to provide the total coma correction for all three beams.

A gun embodiment 64 incorporating one form of novel shunts 66 located concentrically about the two outer beams B and R is shown in FIG. 7. These shunts 66 and the shunts to be described later are constructed of a high magnetic permeability material such as an alloy of 52-percent nickel and 48-percent iron known as "52 metal". The shunts 66 have increased outer diameters compared to the shunts 54 of the prior art gun 58 shown in FIG. 4. Because of the larger outer diameter, portions of the shunts 66, i.e., the outer peripheral edge, in the plane of the beams are closer to the center beam G than they are to the outer beams B and R.

The effect that the shunts 66 have on the vertical and horizontal deflection fields is shown in FIG. 8. As do the shunts of the Hughes U.S. Pat. No. 3,772,554, the novel shunts 66 provide complete bypassing of a portion of the two deflection fields from the outer beams. If the thickness of the shunts 54 and 66 are the same, the net effect on the outer beam rasters will be approximately the same. However, the effect the novel shunts 66 have on the two magnetic deflection fields with respect to the center beam raster is considerably different than attained with the prior art shunts 54. First, since the novel shunts 66 are of considerably greater diameter they will collect more lines of flux from the vertical deflection field and therefore will provide greater enhancement of this field. Second, since the shunts 66 are so close together at their nearest points and therefore are close to the center beam, they tend to draw the flux lines of the horizontal deflection field away from the vicinity of the center beam path to such an extent that the horizontal deflection of the center beam is weakened or, as previously defined, negatively enhanced.

Typical dimensions for a 19 V 90° deflection type tube incorporating the embodiment of FIG. 7 are as follows.

Spacing between center and outer beam paths: 5.08 mm.

Outer diameter of shunts: 5.59 mm.

Internal diameter of shunts: 5.08 mm.

Spacing between center beam path and nearest portions of shunts: 2.29 mm.

Shunt thickness: 0.025 mm.

An alternative, and preferable gun embodiment 70 is shown in FIG. 9. In this gun 70, large circular shunts 72 completely surround and are positioned eccentric to the two outer beam paths B and R, the geometric center of the shunts being located between the outer beam paths and the center beam paths. The direction of eccentricity is toward the center beam path G so as to increase the effect of the negative enhancement of the horizontal deflection field on the center beam. The remaining effect the shunts 72 have on the two deflection fields, as shown in FIG. 10, is very similar to that noted in FIG. 8 with respect to the large concentric shunts.

Typical dimensions for a 25 V 100° deflection type tube incorporating the embodiment of FIG. 9 are as follows.

Spacing between center and outer beam paths: 6.60 mm.

Outer diameter of shunts: 7.24 mm.

Internal diameter of shunts: 5.59 mm.

Spacing between geometric center of shunts and outer beam paths: 0.76 mm.

Spacing between center beam path and nearest portions of shunts: 2.23 mm.

Shunt thickness: 0.09 mm.

Two further gun embodiments 74 and 78 having variations in the shapes of eccentrically positioned shunts are shown in FIGS. 11 and 12, respectively. The gun 74 of FIG. 11 has shunts 76 with elliptical internal and external configurations whereas the gun 78 of FIG. 12 has shunts 80 with a circular internal shape and an elliptical external shape. Such designs are useful for tailoring the effect of the shunts on enhancement of the vertical deflection field on the center beam G.

Although the present invention has been described with respect to a tube having a unitized type inline gun with small spacings between beam paths, it should be understood that the invention is also applicable to other tubes having different types of inline electron guns such as those having larger beam path spacings and/or nonunitized construction.

What I claim is:

1. In a color picture tube having an inline electron gun for generating and directing three electron beams, comprising a center beam and two outer beams, along coplanar paths toward a screen of said tube, wherein the beams pass through a deflection zone adapted to have vertical and horizontal magnetic deflection fields established therein, the improvement comprising:

means for weakening the effect of a portion of the horizontal magnetic deflection field on the center electron beam and for strengthening the effect of a portion of the vertical magnetic deflection field on the center electron beam, said means including magnetically permeable washer-shaped elements completely surrounding the paths of the outer beams, said elements being eccentric with respect to the outer beam paths with the geometric centers of said elements being located between the outer beam paths and the center beam path.

2. In a color picture tube having an inline electron gun for generating and directing three electron beams, comprising a center beam and two outer beams, along coplanar paths toward a screen of said tube, wherein the beams pass through a deflection zone adapted to have vertical and horizontal deflection fields established therein, the improvement comprising:

means for weakening the effect of a portion of the horizontal magnetic deflection field on the center electron beam and for strengthening the effect of a portion of the vertical magnetic deflection field on the center electron beam, said means including magnetically permeable elliptically-shaped washers completely surrounding the paths of the outer beams, the major axis of said elliptically shaped washers being coincident with a line passing substantially perpendicularly through said three electron beams.

* * * * *